United States Patent [19]

Kinnamon

[11] Patent Number: 4,498,857

[45] Date of Patent: Feb. 12, 1985

[54] APPARATUS FOR FORMING ADOBE BRICKS AND DRILLING WELLS

[75] Inventor: Herbert D. Kinnamon, Queen Creek, Ariz.

[73] Assignee: Loyce O. Burks, Phoenix, Ariz. ; a part interest

[21] Appl. No.: 556,983

[22] Filed: Dec. 1, 1983

[51] Int. Cl.[3] ..... B28B 5/08; E02D 7/06

[52] U.S. Cl. ..... 425/361; 74/99 A; 74/103; 74/107; 100/283; 100/292; 405/232; 425/422; 425/444

[58] Field of Search ..... 425/361, 236, 352, 358, 425/412, 444, 422; 100/283, 291, 292; 74/99 A, 99 R, 102, 103, 107; 405/232

[56] References Cited

U.S. PATENT DOCUMENTS

| | | | |
|---|---|---|---|
| 195,280 | 9/1877 | Hodges, Jr. | 100/291 |
| 272,224 | 2/1883 | Fitzpatrick | 425/361 |
| 370,509 | 9/1887 | Webb | 100/291 |
| 406,754 | 7/1889 | Mead | 425/412 |
| 852,839 | 5/1907 | Howell | 425/428 |
| 1,392,863 | 10/1921 | Webke | 425/412 |
| 1,784,792 | 12/1930 | Hawley | 425/193 |
| 2,001,247 | 5/1935 | Gourley et al. | 74/103 |
| 2,218,343 | 10/1940 | Porter | 74/103 |
| 2,402,393 | 6/1946 | Griffith | 405/232 |
| 2,559,422 | 7/1951 | Garnich | 425/424 |
| 2,788,854 | 4/1957 | Brandt | 74/103 |
| 3,580,794 | 5/1971 | Mintz | 100/291 |
| 3,956,516 | 5/1976 | Holt et al. | 425/361 |
| 4,008,021 | 2/1977 | Ferdigo et al. | 425/3 |

*Primary Examiner*—Jay H. Woo
*Assistant Examiner*—James C. Housel
*Attorney, Agent, or Firm*—Warren F. B. Lindsley

[57] ABSTRACT

An improved apparatus for the continuous and relatively labor-free fabrication of adobe bricks and the forcing of well casings into the earth. With regard to forming adobe bricks, a rotating table carries the bricks being processed from one station to the next and a novel means for applying unusually high forming pressures permits immediate forming and ejection of the bricks from the forms while at the same time producing adobe bricks of improved quality and hardness characteristics.

6 Claims, 18 Drawing Figures

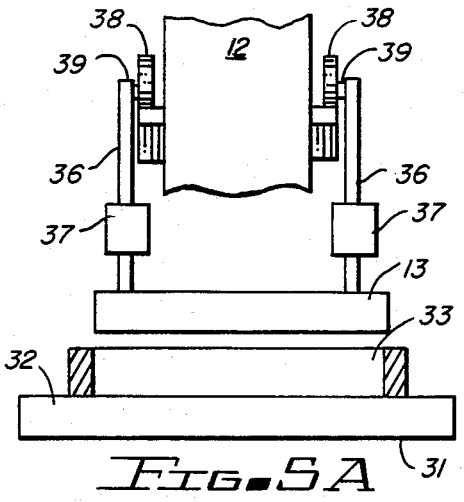
FIG. 5A
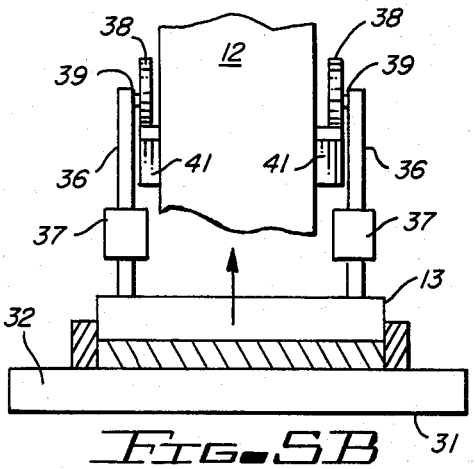
FIG. 5B
FIG. 6A
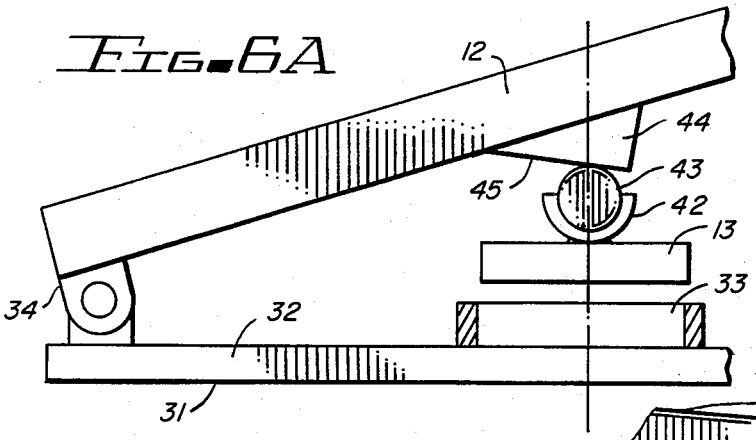
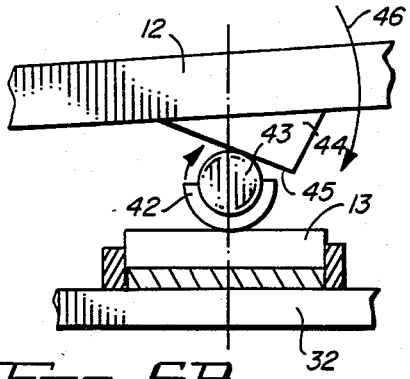
FIG. 6B
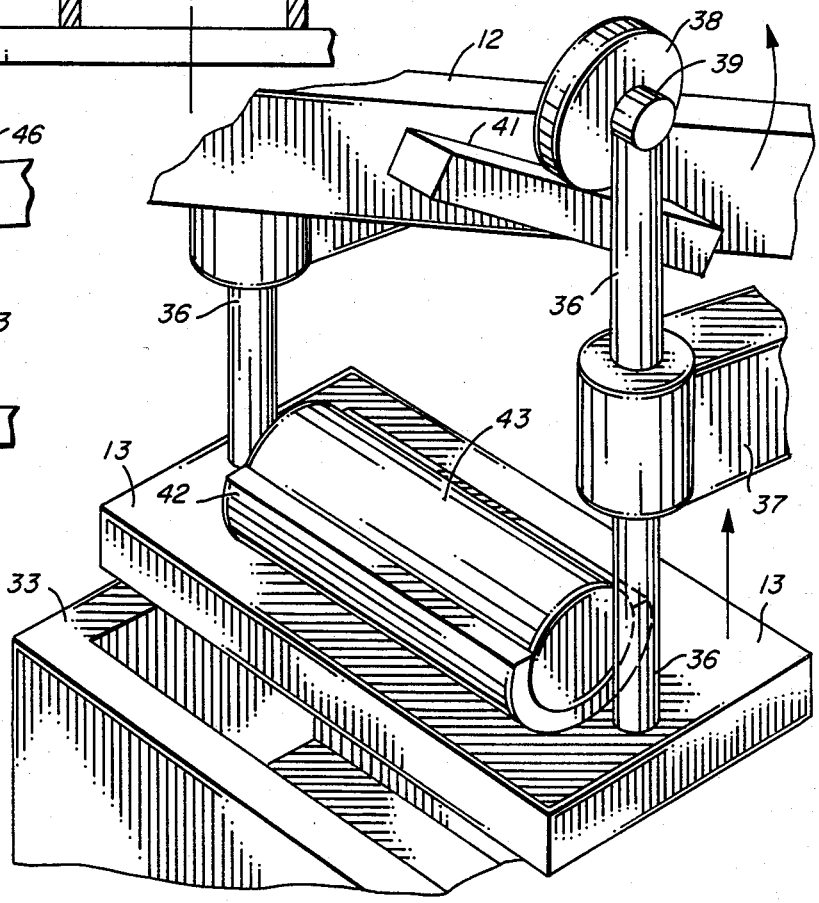
FIG. 7

FIG. 8A
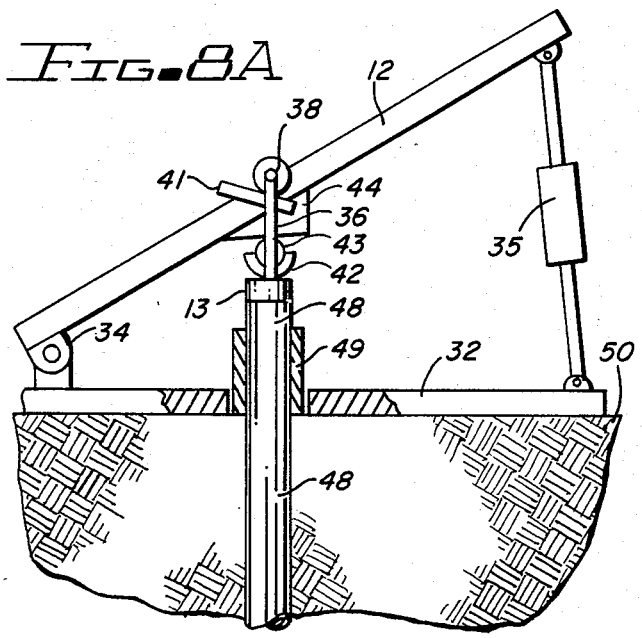
FIG. 8C
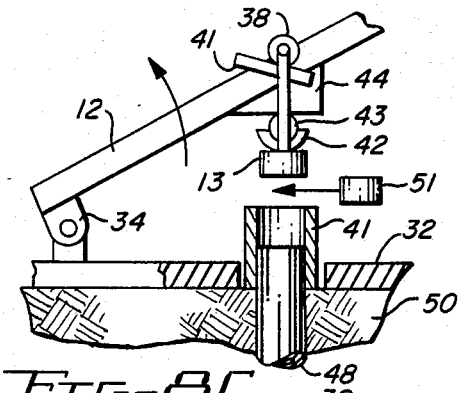
FIG. 8B
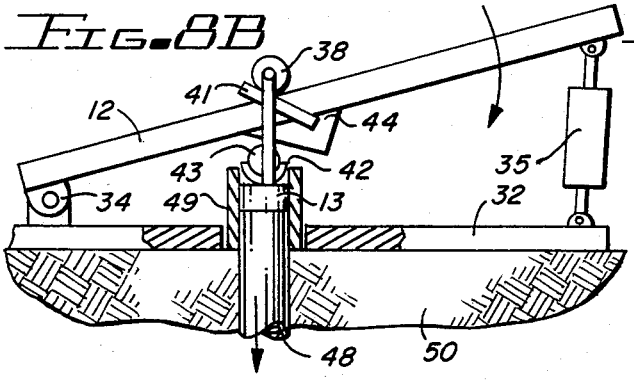
FIG. 8D
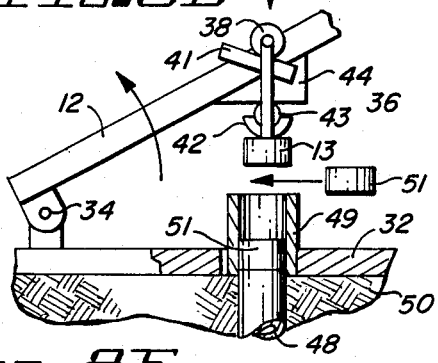
FIG. 8E
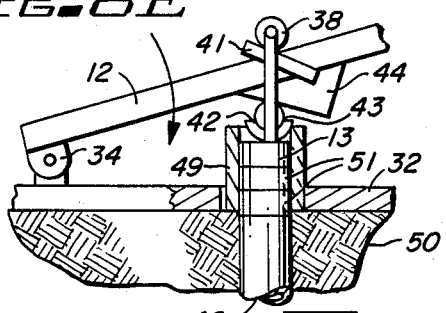
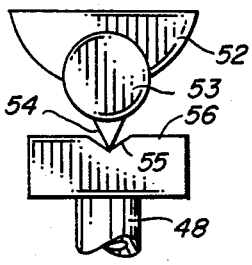
FIG. 10
FIG. 8F
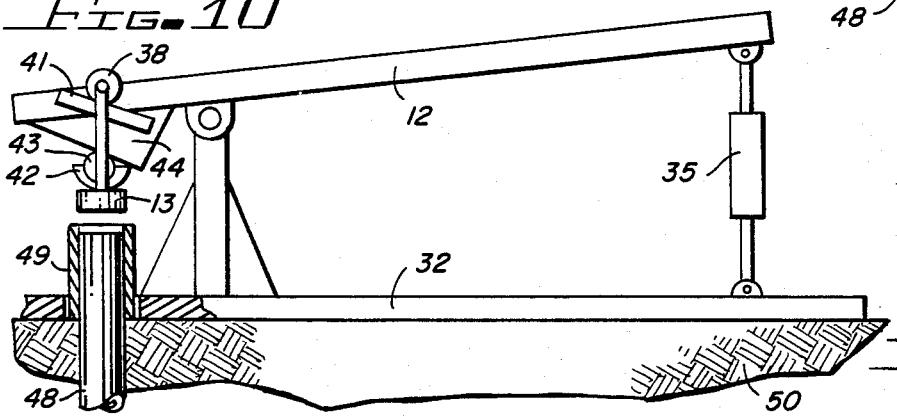
FIG. 9

APPARATUS FOR FORMING ADOBE BRICKS AND DRILLING WELLS

BACKGROUND OF THE INVENTION

Adobe is the Spanish name for unburnt sun-dried bricks used to build houses and other structures for thousands of years as evident from the early efforts of the ancient Egyptians and Babylonians.

Adobe houses are still common in Mexico and the southwestern part of the United States since they are cooler than uninsulated homes made of wood and stone.

Adobe bricks are ordinarily made by mixing sandy clay or loam with water and a small quantity of some fibrous material such as straw or grass. This mixture is placed in forms that shape it into bricks. In the past, the material was sun-dried while still in the forms, the drying process requiring from ten to fourteen days of curing in the sun.

The old or traditional process for making adobe bricks as described above is not practical in today's building procedures. The hand labor involved is too slow and expensive and the process is too time consuming. For large-quantity production, an inordinately large quantity of forms would be required. When measured against today's building standards, the crude adobe bricks formed by the above described hand procedure is also lacking in hardness, especially its ability to withstand various weather conditions.

Rising costs of fuels and building materials, however, have brought about a renewed interest in adobe bricks as a building material. Modern methods and improved materials are now producing a higher quality adobe brick at lower costs than heretofore available.

One important discovery in connection with such improvements is that a better quality adobe brick can be produced if higher forming pressures are used. Furthermore, when the bricks are formed under high pressure, they may be removed from the mold prior to drying so that a single form or mold can be used to produce a large number of bricks in a relatively short period of time.

The present invention is directed toward an improved apparatus for providing relatively high pressures for forming adobe bricks and for use in forcing water, gas and oil well pipe casings and associated drilling equipment into the earth. A key feature of the apparatus is an arrangement whereby a pivotal force from an angularly moved lever arm is converted into a vertically directed force that produces very high compression forces required in the improved processes.

DESCRIPTION OF THE PRIOR ART

Various arrangements have been employed in the past for converting a pivotal force from a lever arm into a vertical force.

U.S. Pat. No. 1,784,792 discloses a press for making insulators wherein a vertically restrained rod is driven by a lever arm. The lever arm is coupled to the rod by a pin-and-slot arrangement that permits only the vertical component of lever motion to be transmitted to the rod.

U.S. Pat. No. 852,839 also employs a pin-and-slot arrangement under similar circumstances.

U.S. Pat. No. 4,008,021 transfers force from a rocker arm to a vertical rod by means of a pin operating between a pair of flanges.

U.S. Pat. No. 406,754 discloses a roller driven by a cam.

U.S. Pat. No. 2,559,422 drives a cam with a lever. A roller secured to the vertical rod rides upon and is driven by a rotating cam.

While such prior art arrangements effectively convert a pivotal lever force into a vertical force, they are not entirely satisfactory for application to the apparatus of the present invention because of the very high forming or molding pressures required.

SUMMARY OF THE INVENTION

In accordance with the invention claimed, an improved apparatus is provided for pressing and molding adobe bricks and for forcing well casings into the earth under very high pressures. A key feature of the apparatus involves the use of a roller and cradle arrangement for conversion of a pivotal movement into a vertical component.

It is, therefore, one object of this invention to provide an improved dual purpose apparatus for forming and pressing adobe bricks and for forcing well casings into the earth.

Another object of this invention is to provide such an apparatus which will convert the adobe brick manufacturing process from a low volume, high cost batch process into a high volume, low cost continuous line process with a low labor content.

A further object of this invention is to provide an improved adobe brick manufacturing apparatus which incorporates progressive stages for the filling, forming, pressing and mold removing process steps.

A still further object of this invention is to provide in such an improved apparatus, efficient means for applying very high forming pressures which contribute to both the efficiency of the process and to the quality of the product.

Yet another object of this invention is to provide in connection with the application of such high forming pressures a means for the efficient conversion of a pivotal lever arm movement into a vertical force for driving the pressing ram of the apparatus.

Further objects and advantages of the invention will become apparent as the following description proceeds, and the features of novelty which characterize the invention will be pointed out with particularity in the claims annexed to and forming a part of this specification.

BRIEF DESCRIPTION OF THE DRAWINGS

The present invention may be more readily described with reference to the accompanying drawings, in which:

FIG. 5A is a partial end view of the apparatus shown in FIG. 1 illustrating the mechanism for raising the ram with the ram being shown in its raised position;

FIG. 5B is the same partial end view shown in FIG. 5A but with the ram shown in its lowered position;

FIG. 6A is a partial side view of the apparatus shown in FIG. 1 illustrating the mechanism for lowering the material compressing ram, with the ram shown in its raised position;

FIG. 6B is the same partial end view shown in FIG. 6A but with the ram shown in the lowered position;

FIG. 7 is a perspective view showing the raising and the lowering mechanisms of FIGS. 4A, 4B, 5A, 5B, 6A and 6B;

FIG. 8A is a partial side view of a modification of the apparatus shown in FIGS. 6A and 6B adapted for driving pipe or casing sections into the ground with the lever arm in its extended position;

FIG. 8B is a view similar to FIG. 8A with the lever arm in its compressing and retracted position;

FIGS. 8C–8F illustrate a sequence of steps in the process of driving a well pipe or casing into the earth using driving discs to take up the slack;

FIG. 9 is a modification of the structure shown in FIGS. 1–8F wherein a well casing driving mechanism is shown at the end of the lever arm; and FIG. 10 is a prospective illustration of a modification of the mechanism for transferring lateral movement into vertical movement shown in FIGS. 1–8F.

DESCRIPTION OF THE PREFERRED EMBODIMENT

Figure 1:
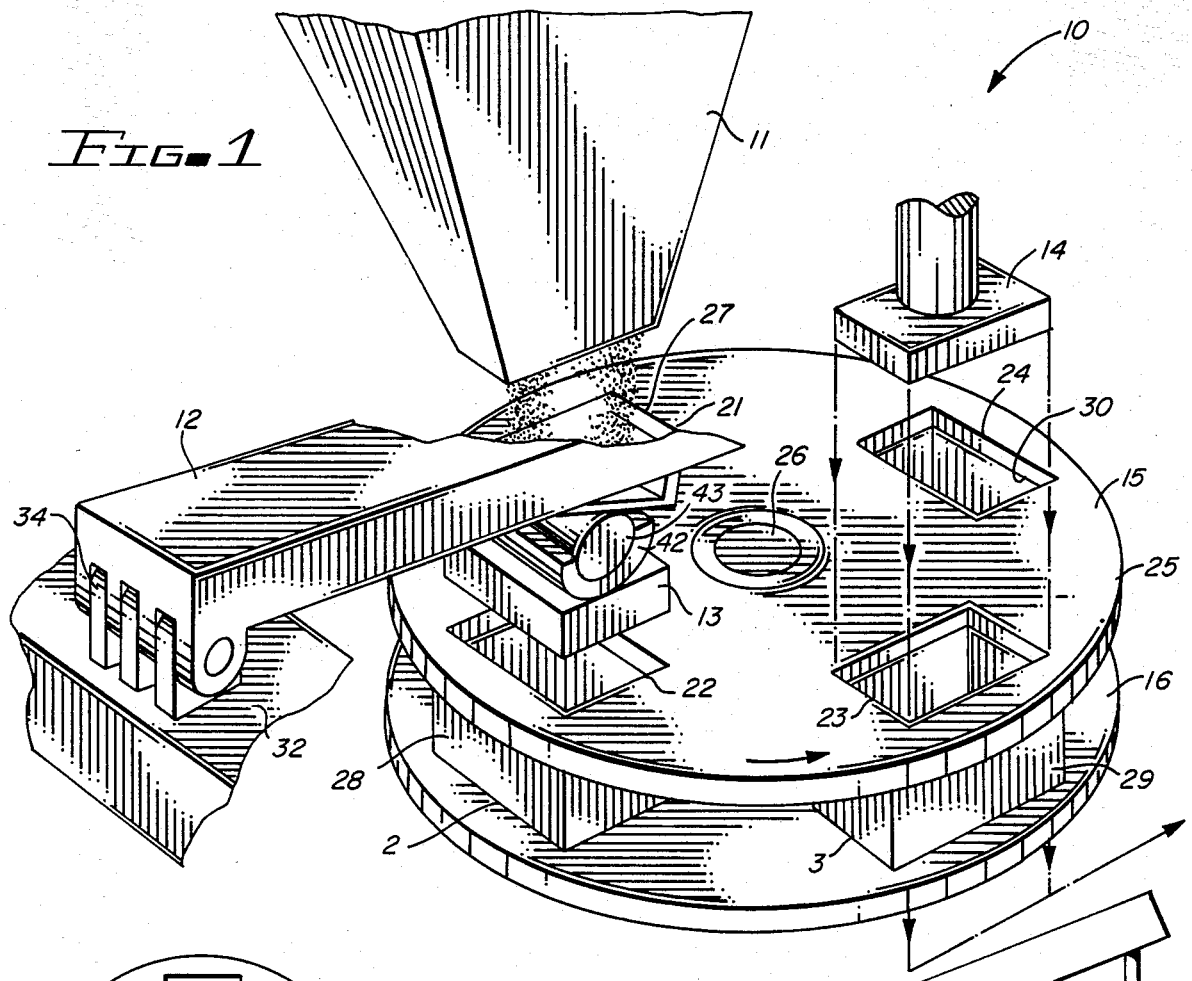
FIG. 1 is a partial perspective view of an improved adobe brick manufacturing apparatus embodying the invention with support members partially cut away to reveal working portions of the apparatus.

Referring more particularly to the drawings by characters of reference, FIGS. 1–7 disclose an improved adobe brick manufacturing apparatus 10 comprising a raw material chute 11, a pivotal ram drive arm 12, means comprising a pressing shaft or ram 13, a brick ejector ram 14, a rotating upper table 15 and a stationary lower table 16.

Figure 3:
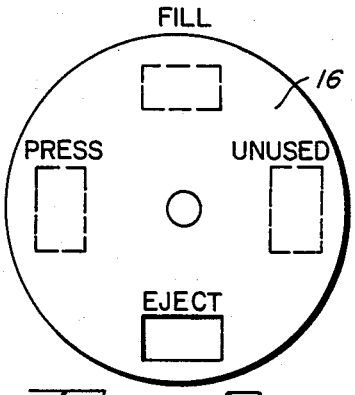
FIG. 3 is a top plan view of a stationary table mounted below the rotating table and showing the successive operating stages of the apparatus.

FIG. 3 illustrates the stationary lower table 16 with its four processing stations 1–4. At each of the stations a particular process is carried out with station 1 being the point at which the mold positioned thereabove is filled with a mixture of raw materials. At station 2 the raw materials in the mold are compressed under high pressure into a brick configuration. At station 3 the brick is ejected from its mold. Station 4 is not used in this embodiment of the invention. The broken lines outlining stations 1, 2 and 4 indicate that the surface of table 16 is continuous over these station areas, while the solid line showing of station 3 indicates a rectangular opening extending through the table 16 at this position.

Figure 2:
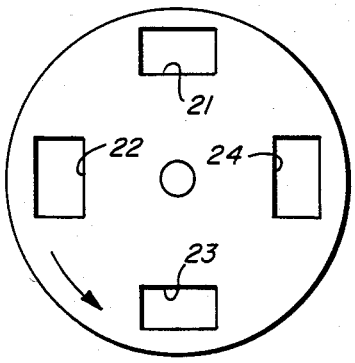
FIG. 2 is a top plan view of a rotating table incorporated in the apparatus of FIG. 1, the plan view showing four compartments or brick forming molds that are mounted on the table.

The four stations 21, 22, 23 and 24 shown in FIG. 2 comprise four adobe brick forms or molds which are supported at their upper edges from the edges of corresponding openings in upper table 15.

It will be noted from FIG. 1 that station 22 of table 15 is aligned with station 2 of lower table 16, and with pressing ram 13. Similarly, station 23 of table 15 is aligned with station 3 of table 16 and with ejecting ram 14, while station 21 of table 15 is aligned with station 1 of table 16 and with the material dispensing chute 11 which fills the mold of station 21 with raw material. The already filled mold at station 22 is compressed by ram 13 and the previously pressed brick in the mold at station 23 is ejected downwardly from the apparatus by ram 14.

While lower stationary table 16 comprises a sturdy flat surface with only one rectangular opening at station 3, rotating upper table 15 comprises a flat circular supporting plate 25, rotatably mounted at its center by an axis 26, with four brick forms or molds 27, 28, 29 and 30 mounted respectively one at each of the stations 21, 22, 23 and 24. Each of the forms 27–30 comprises four horizontal walls joined at their corners to form a rectangular open ended box having inner dimensions as appropriate for the desired brick sizes.

While the mechanisms for introducing raw materials from chute 11, for ejecting the pressed bricks from the associated mold and for rotating table 15 are readily implemented by conventional means, the means for applying the very high pressures to ram 13 for compressing the raw material into adobe bricks is a new and novel mechanism comprising in combination the claimed subject matter of this invention. For this reason, the raising and lowering mechanisms are shown in the drawings with the further description of this apparatus particularly directed toward the mechanism for raising and lowering ram 13.

It should be noted that the upper edges of the horizontal walls of the molds 27–30 are secured within the rectangular openings of stations 21–24 respectively, and the lower ends of molds 27–30 are open. Tables 15 and 16 are arranged parallel with each other with the vertical position of molds 27–30 being such that the lower edges of molds 27–30 rest upon the top surface of table 16. Thus when raw material is introduced into station 21 from chute 11, as shown in FIG. 1, the bottom of mold 27 is closed by the upper surface of table 16, and when ram 13 is lowered into mold 28 of station 22 the bottom of mold 28 is closed by the top surface of table 16 and the raw material is compressed against the upper surface of table 16, while the opening in table 16 at station 3 permits passage of the compressed brick downwardly through table 16 under the effect of ejector ram 14. While neither FIG. 1 nor FIGS. 4A through 7 show both tables 15 and 16 together with the complete mechanisms for raising and lowering ram 13, it should be noted that the top surface of table 15 is juxtapositioned with and underneath the undersurface 31 of a platform 32 upon which the raising and lowering mechanisms are mounted. Clearance openings (not shown) through flange 33 in platform 32 for ram 13 and ejector ram 14 are aligned with stations 1–4 of table 16 to permit access to forms 27–30 from above platform 32.

The raising mechanism will be described first with reference to FIGS. 4A–5B and FIG. 7.

Figure 4A:
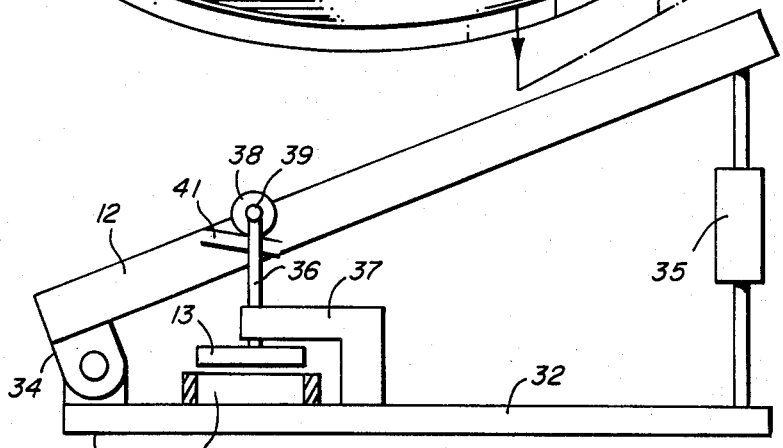
FIG. 4A is a partial side view of the apparatus of FIG. 1 illustrating the force transmitting mechanism and its material compressing ram shown in its raised position.
Figure 4B:
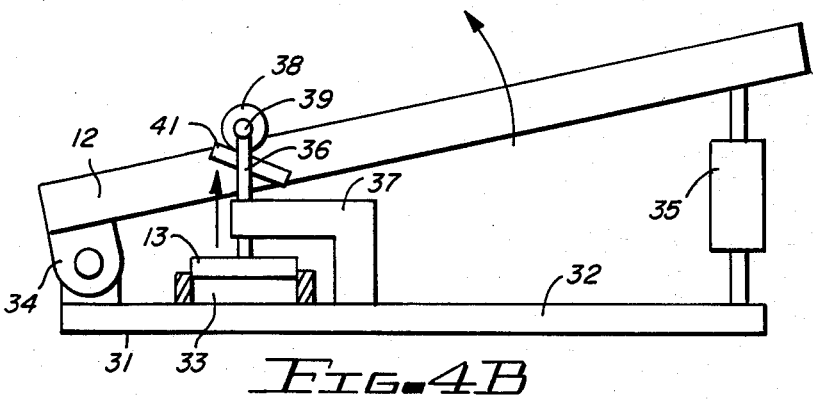
FIG. 4B is the same partial side view shown in FIG. 4A but with the ram shown in its lower position.

The ram drive arm 12, as shown in FIGS. 4A and 4B, is pivotally secured at one end to platform 32 by means of a heavy hinge 34. Its opposite end is driven by a hydraulic piston or ram mechanism 35. The pressing ram 13 is carried at the lower ends of two vertically positioned ram shafts 36 which pass through vertical bearing shaft openings in two ram shaft supports 37 which are mounted upon platform 32 as shown in FIGS. 4A and 4B. The upper ends of shafts 36 are each provided with a rotating wheel 38 which is rotatably mounted upon a horizontal axis 39 which is secured to the upper ends of one of shafts 36. The other ends of shafts 36 are attached near opposite ends of the rectangular shaped ram 13, in a substantially parallel arrangement with each other. As noted, they rise vertically, one on either side of arm 12. One of each of the wheels 38 rides upon a cam or track 41 that is secured to one side of arm 12 while the other wheel 38 is similarly mounted with its associated cam follower or wheel 38 riding on an identical cam or track 41 secured to the opposite side of arm 12. The tracks 41 are positioned relatively near the hinged end of arm 12 so as to afford an appreciable mechanical advantage for the driving of arm 12 by hydraulic ram means 35. The passage of shafts 36 through the shaft openings or bearings of supports 37 assures the vertical orientation of shafts 36 and hence the vertical motion of ram 13. Comparison of FIGS. 4A and 4B with FIGS. 5A and 5B will help to clarify the arrangement of these mechanisms as just described.

To raise or lower arm 13 by means of the lowering mechanism just described, the pneumatic ram means 35 is extended or withdrawn to pivot arm 12 about hinge 34. As ram 35 is extended, arm 12 rises and track 41 follows an arc about hinge 34. Track 41 thus has a horizontal motion to the left as ram means 35 is extended as well as its desired upward motion relative to ram 13. Wheel 38 must, therefore, rotate upon track 41 if it is to maintain a fixed position relative to the horizontal. In order to facilitate such relative motion, track 41 is inclined relative to a longitudinal axis of arm 12 and relative to the horizontal so that its right-hand end is lower than its left-hand end as shown in FIGS. 4A and 4B for all normal operating positions of arm 12. It is thus apparent that as arm 12 is moved upwardly from its lowered position, as shown in FIG. 4B, toward its raised position shown in FIG. 4A, wheel 48 rotates counterclockwise and rolls leftward upon track 41 while shaft 36 maintains a vertical orientation. Similarly, as arm 12 is lowered, wheel 38 turns clockwise and moves to the right relative to the track 41 while shaft 36 moves vertically downwardly. With the vertical motion of shaft 36 and ram 13 thus assured, ram 13 moves freely within the walls of the forms 27–30.

The key element of this invention is the means by which the exceptionally high compression forces are applied during the forming of the bricks at station 2. As shown in FIGS. 1, 6A, 6B and 7, the compression means or mechanism for applying these high compression forces includes ram 13, a cradle 42, a roller bar 43, an inclined pressure plate 44 and drive arm 12, which is brought pivotally downwardly under the influence of hydraulic ram means 35. Cradle 42 comprises a cylindrical half-section which is formed by cutting a hollow cylinder lengthwise through its center. The cradle is welded to the top surface of ram 13 with its open side facing upwardly. Roller bar 43 is a solid cylindrical bar cut to a length matching that of cradle 42.

As shown in FIG. 7, the lengths of cradle 42 and bar 43 are only slightly shorter than the length of ram 13, the somewhat longer length of ram 13 permitting the attachment of shafts 36 to ram 13 at the ends of cradle 42. The diameter of bar 43 is nearly equal to the inside diameter of cradle 42, so that bar 43 is smoothly but snugly rotatable within cradle 42. An appropriate lubricant is applied to the adjoining surfaces of bar 43 and cradle 42. Inclined pressure plate 44 is welded to the under-surface of arm 12 at a point directly over bar 43 so that when arm 12 is driven downwardly under the influence of ram means 35 the lower inclined surface 45 of plate 44 impinges upon the upper cylindrical surface of bar 43 which extends upwardly from cradle 42.

The operation of the mechanism just described during the application of high pressures in the brick forming process occurs as follows: When the end of arm 12 opposite hinge 34 is drawn downward by ram means 35, pressure plate 44 follows an arc 46 drawn about hinge 34. A given point on surface 45 thus experiences both a horizontal and a vertical component of motion during the lowering of arm 12. Because ram 13 with the attached cradle 42 and roller bar 43 are constrained to move vertically by virtue of shafts 36 and supports 37, surface 45 must move horizontally over the surface of roller bar 43 relative to ram 13, cradle 42 and bar 43. This relative horizontal motion of surface 45 is accomodated by the freedom of bar 43 to rotate within cradle 42. Thus, as surface 45 moves downwardly and to the right, as shown in FIG. 6A, bar 43 rotates clockwise within cradle 42. To further facilitate this rotational action, the angle of inclination of surface 45 is chosen to assure that throughout the pressing cycle surface 45 is inclined downwardly to the right as shown in FIGS. 6A and 6B.

Because ram 13, cradle 42, bar 43, plate 44, arm 12, and hinge 34 are all of very heavy construction, exceedingly high compression forces may be applied without incurring damage to these parts.

A highly efficient and effective adobe brick manufacturing apparatus is thus described. In a given position of rotating table 15, raw materials are delivered from chute 11 in a metered quantity to station 1 while the compression operation occurs at station 2 and while the ejection operation occurs at station 3. Upon the completion of these simultaneous operations, table 15 is rotated clockwise one step, so that station 21 of table 15 is now positioned directly over station 2 of table 16. The same three operations are now repeated, after which table 15 is again advanced one step for the next set of simultaneous operations. Table 15 thus constitutes a moving conveyor which moves the bricks in their various stages of fabrication from one processing station to the next. The apparatus thus permits the rapid and relatively labor-free continuous production of adobe bricks in accordance with the stated objects of the invention, and this rapid forming of the bricks under the high pressures required to permit immediate removal from the forms is made possible by virtue of the arrangement described for applying the high forming pressures.

In accordance with the teaching of this invention, the high pressures produced by the apparatus shown in FIGS. 1–7 may equally well be used for forcing pipe casings into the earth.

FIGS. 8A–8F illustrate a modification of the lever mechanism of FIGS. 1–7, wherein like components are given the same reference characters for driving a pipe casing 48 supported by a coaxially mounted collar 49 through platform 32 into the earth 50. As the hydraulic pressure is applied to the top end of casing 48 it is forced into the earth by the retraction of the hydraulic ram 35 in the manner shown in FIGS. 1–7.

With each stroke of the hydraulic ram as shown in FIG. 8B and its retraction to the position shown in FIG. 8C one or more cylindrical blocks 51 are positioned on top of the top end of casing 48 against which the pressing ram 13 acts to push the casing further into the earth in the repetitive manner shown in FIGS. 8D–8F until the proper well casing has reached the depth in the earth desired by the operator.

FIG. 9 illustrates a modification of structures shown in FIGS. 1–8 wherein the pressing providing mechanism shown is shown mounted at the end of the pivotally mounted lever or drive arm 12. It should be noted that a similar pressure providing apparatus 36, 38, 41, 42, 44, 45 and 13 may be also mounted in the position shown in FIGS. 4A, 4B, 5A, 5B, 6A and 6B to render a common apparatus capable of serving the dual function of forming adobe bricks and/or forcing well casings into the earth.

FIG. 10 illustrates a modification of the cradle roller bar arrangement of FIGS. 1–9 wherein the inclined pressure plate 44 may be replaced with a slotted wedge 52. The slotted opening of wedge 52 may be arcuate in form into which a roller bar 53 is mounted. The roller bar 53 is provided with a wedge-shaped flange 54 which fits loosely into a similarly shaped groove 55 in a pressure ram 56. This mechanism may be used for either forming adobe bricks or forcing casings into the earth.

Although but a few embodiments of the invention have been illustrated and described, it will be apparent to those skilled in the art that various changes and modifications may be made therein without departing from the spirit of the invention or from the scope of the appended claims.

What is claimed is:

1. A pressure applying apparatus for forming adobe bricks or driving well casings into the earth comprising:

a platform;

a drive arm pivotally mounted at one end on said platform and movable in a predetermined arcuate path, a hydraulic activated cylinder connected to said drive arm at the other end for pivotally moving said driven arm reciprocally along said arcuate path, ram means connected to said drive arm at a point between its ends for moving in a relatively vertical direction upon arcuate movement of said drive arm, said ram means comprising a first shaft, a guiding support connected at one end to said platform and forming a bearing at the other end for said first shaft, a first track angularly positioned on said drive arm relative to the longitudinal axis of said drive arm, a rotative first wheel mounted on one end of said first shaft supported by said first wheel on said first track for limited movement therealong and a pressure plate mounted on the other end of said first shaft, said ram means activating said first shaft and said pressure plate upon movement of said drive arm in a first direction to remove said pressure plate from an associated mold, and compression means for moving said shaft and pressure plate into an associated mold and applying a force to said ram means upon movement of said drive arm in a first direction comprising a plate mounted on said drive arm having a surface arranged angularly with respect to the longitudinal axis of said drive arm, a cradle mounted on said pressure plate and a roller bar mounted in said cradle for physical contact with said surface upon predetermined angular movement of said drive arm in said second direction, said drive arm upon movement in said second direction by said ram means causing said surface to engage said roller bar and a relative movement of said surface and said roller bar over each other to maintain a vertical movement of said shaft and pressure plate relative to the angular movement of said drive arm.

2. The apparatus set forth in claim 1 wherein:

said ram means comprises a second shaft, a second guiding support and a second track mounted on another side of said drive arm from said first track, the other ends of said shafts being spacedly connected to said pressure plate on opposite ends of said cradle.

3. The apparatus set forth in claim 1 wherein:

said track comprises a cam, and said wheel comprises a cam follower.

4. The apparatus set forth in claim 1 in further combination with:

a mold mounted in the path of movement of said pressure plate.

5. The apparatus set forth in claim 1 in further combination with:

a revolving table means, and a plurality of molds mounted on said table means, said table means being rotated to sequestially position each of said molds in the path of movement of said ram means.

6. The apparatus set forth in claim 5 in further combination with:

a brick ejecting ram mounted on said platform for sequentially ejecting bricks from each of said molds.

* * * * *